US006644403B2

(12) United States Patent
Pichery et al.

(10) Patent No.: US 6,644,403 B2
(45) Date of Patent: Nov. 11, 2003

(54) METHOD AND DEVICE FOR THE MEASURING PHYSICAL PARAMETERS IN A PRODUCTION SHAFT OF A DEPOSIT OF UNDERGROUND FLUID STORAGE RESERVOIR

(75) Inventors: Thierry Pichery, Saint Martin-du-Tertre (FR); Christian Sirieix, Mezieres-sur-Seine (FR)

(73) Assignee: Gaz de France, Paris (FR)

( * ) Notice: Subject to any disclaimer, the term of this patent is extended or adjusted under 35 U.S.C. 154(b) by 0 days.

(21) Appl. No.: 10/019,933

(22) PCT Filed: May 11, 2001

(86) PCT No.: PCT/FR01/01424

§ 371 (c)(1),
(2), (4) Date: Jan. 7, 2002

(87) PCT Pub. No.: WO01/86117

PCT Pub. Date: Nov. 15, 2001

(65) Prior Publication Data

US 2003/0159823 A1 Aug. 28, 2003

(30) Foreign Application Priority Data

May 12, 2000 (FR) ..... 00 06099

(51) Int. Cl.[7] ..... E21B 47/01; E21B 47/12; E21B 43/00

(52) U.S. Cl. ..... 166/250.11; 166/242.5; 166/64; 166/66; 73/152.18; 73/152.53

(58) Field of Search ..... 166/250.01, 250.11, 166/53, 65.1, 66, 66.5, 64, 162, 242.1, 242.5; 73/152.01, 152.02, 152.18, 152.51, 152.53

(56) References Cited

U.S. PATENT DOCUMENTS 3,835,929 A 9/1974 Suman, Jr.
4,033,413 A * 7/1977 Rogers ..... 166/301
4,105,279 A * 8/1978 Glotin et al. ..... 166/117.5
4,660,638 A * 4/1987 Yates, Jr. ..... 166/250.09
5,130,705 A * 7/1992 Allen et al. ..... 166/66
5,355,952 A * 10/1994 Meynier ..... 166/250.01
5,455,573 A 10/1995 Delatorre
5,457,988 A 10/1995 Delatorre
5,706,892 A * 1/1998 Aeschbacher et al. ..... 166/66
5,740,860 A * 4/1998 Crawford et al. ..... 166/64
5,839,508 A * 11/1998 Tubel et al. ..... 166/65.1
5,971,072 A * 10/1999 Huber et al. ..... 166/297

(List continued on next page.)

FOREIGN PATENT DOCUMENTS

DE 3402386 A1 8/1985
GB 2193239 A * 2/1988 ..... E21B/47/06
GB 2311546 A 10/1997
GB 2335453 9/1999
WO WO 97/18381 5/1997

*Primary Examiner*—David Bagnell
*Assistant Examiner*—Jennifer H Gay
(74) *Attorney, Agent, or Firm*—McDermott, Will & Emery

(57) ABSTRACT

An operating well of a fluid storage reserve, includes an outer wall delimiting, with a central operating tubing of the well, an annular space in which is placed a protective sheath of an electrical link cable between a surface installation and elements arranged in the well. A device for the measurement of physical parameters includes at least one compact, removable, sealed measuring subassembly arranged in a housing in communication with the interior of the central tubing and at least one compact, sealed connecting subassembly integral with the central tubing of the well and arranged at least partially in the annular space in the vicinity of the protective sheath to be connected to the electrical link cable. The sealed measuring subassembly and the sealed connecting subassembly have plane contact surfaces, each associated with a half-transformer so as to form an inductive coupling between the measuring subassembly and the connecting subassembly.

21 Claims, 3 Drawing Sheets

U.S. PATENT DOCUMENTS 6,075,462 A * 6/2000 Smith ..... 166/250.15
6,082,455 A * 7/2000 Pringle et al. ..... 166/250.15
6,334,489 B1 * 1/2002 Shwe et al. ..... 166/250.01
6,422,312 B1 * 7/2002 Delatorre et al. ..... 166/250.15
6,459,383 B1 * 10/2002 Delatorre ..... 166/250.11
6,464,004 B1 * 10/2002 Crawford et al. ..... 166/250.01
6,515,592 B1 * 2/2003 Babour et al. ..... 166/66
2002/0000316 A1 * 1/2002 Haase ..... 166/244.1

* cited by examiner

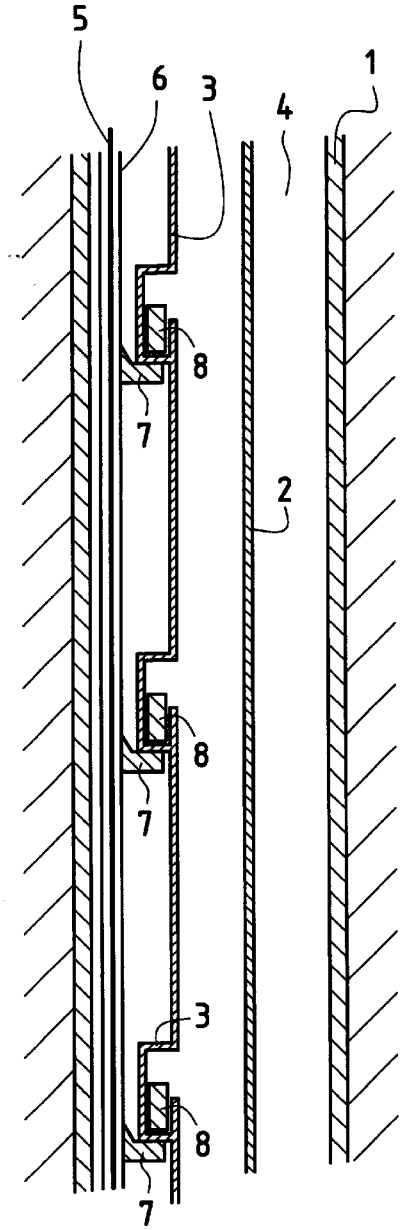
FIG.1
FIG.2
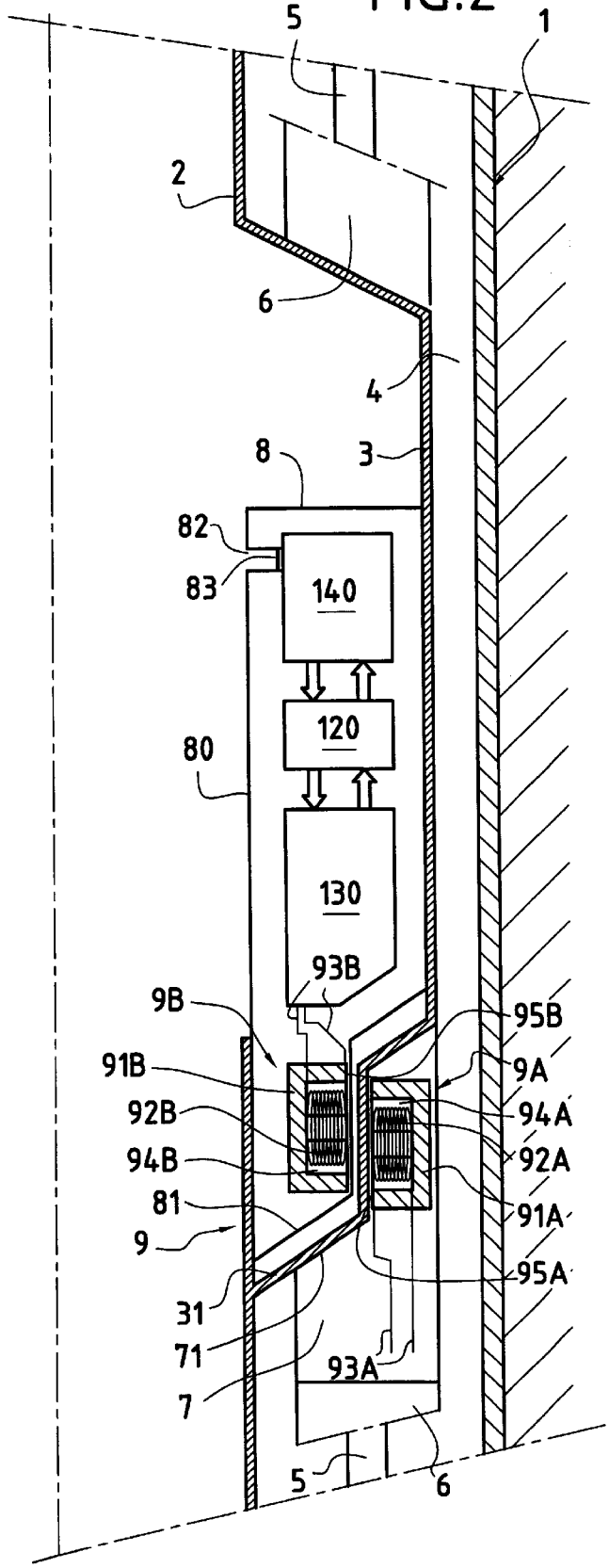

FIG.5
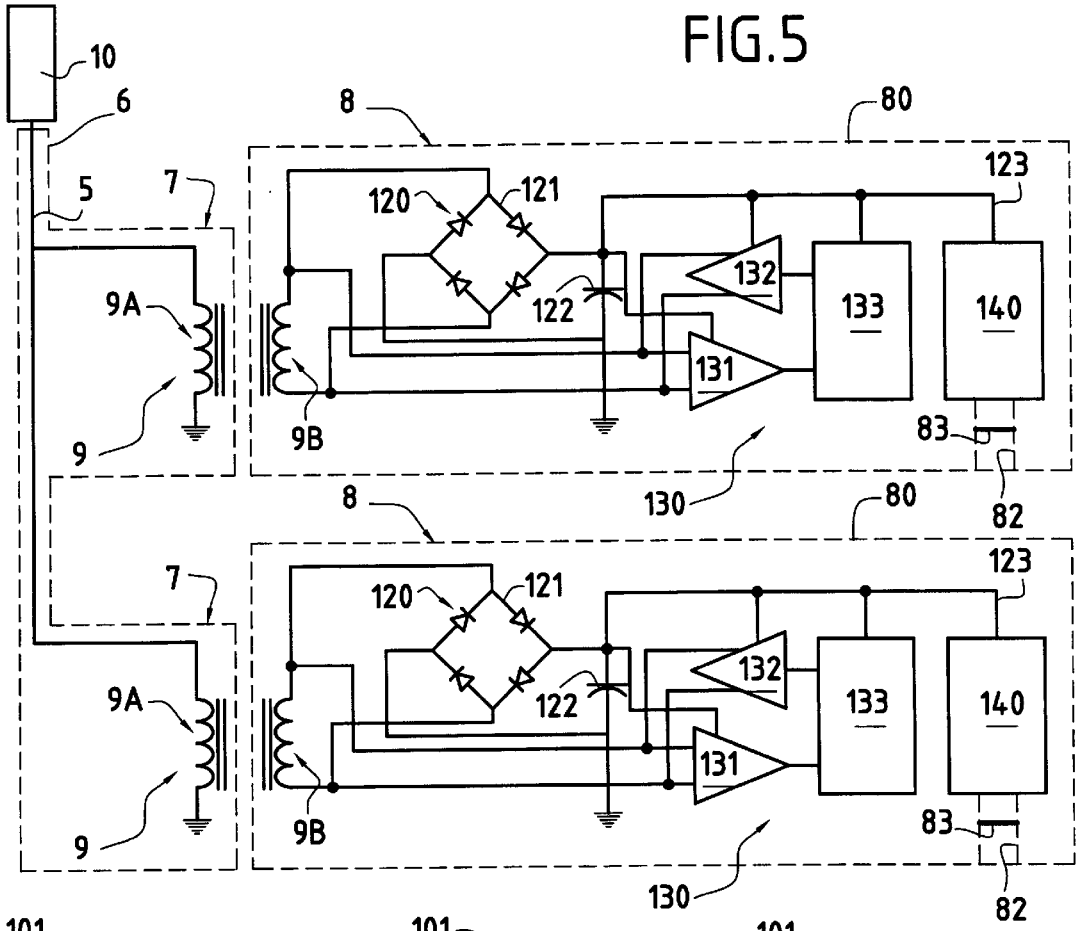
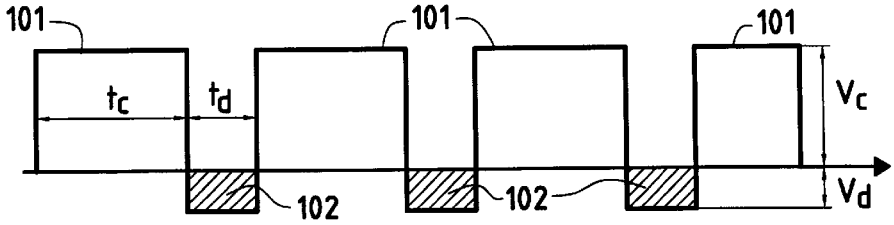
FIG.6
FIG.7
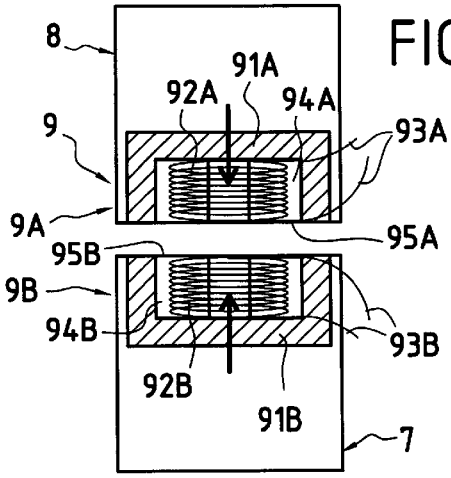
FIG.8
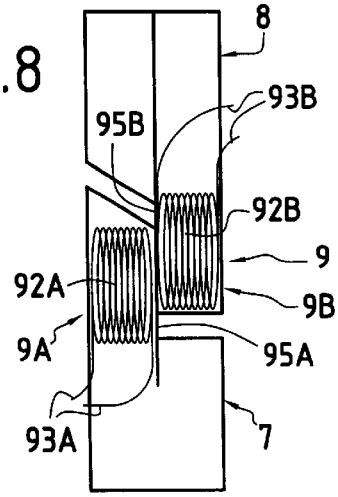

METHOD AND DEVICE FOR THE MEASURING PHYSICAL PARAMETERS IN A PRODUCTION SHAFT OF A DEPOSIT OF UNDERGROUND FLUID STORAGE RESERVOIR

FIELD OF THE INVENTION

The present invention concerns a method and a device for the measurement of physical parameters in an operating well of a deposit or underground fluid storage reserve.

In the case of underground storage of a fluid such as natural gas, control of storage performance involves access to data on the reservoirs and associated wells which are reliable and up to date. This is the case in particular with deposit pressure values which must be checked regularly for storage in water-bearing deposits.

BACKGROUND OF THE INVENTION

At present, these quantities are most often evaluated on the basis of measurements made at the well head. Such measurements make it possible to have information on the situation at the bottom of a well only approximately, which may cause significant errors on storage performance forecasts.

Whether it is for sites in water-bearing deposits or for saline cavities, it is essential to be able to have information on physical parameters, particularly on the pressure, in the conditions at the bottom of an operating well, and not just at the well head.

It has already been proposed to introduce physical measurement sensors in an annular space defined between a central operating tubing and the outer cylindrical wall of the well. In this case, the sensors are connected to the surface by a wire link also situated in the annular space in which the fluid worked does not circulate. This solution enables measurement in real time of the well bottom conditions.

However, the sensor and the electronic circuits which are associated with it, which are integrated in the well structure, cannot be removed for maintenance or replacement without an operation of repair of the well structure itself being performed, which is particularly expensive since it requires removal of all or part of the well structure. In so far as the sensor and the associated electronic circuits are not situated in an easy-access zone allowing repair or exchange to be carried out rapidly, since any operation of positioning or depositing a sensor can be done only on the occasion of repair of the well, it is necessary, in order to obtain the required reliability and ensure continuity of measurements, to choose high-cost sensors and electronic circuits to meet the difficult environmental conditions, and to install a redundant number of sensors and electronic circuits.

It has further been proposed to install, in the interior itself of an operating tubing of a well, by cable work, a measurement module which can thus be arranged at the bottom of the well. The data are transmitted from the measurement module situated at the bottom of the well, to a transceiver situated at the surface in the vicinity of the well. Transmission is effected wirelessly between the buried module and the transceiver at the surface by electromagnetic radiation through the geological strata. Wireless transmission is however highly energy-consuming and imposes restrictions on the energy source (accumulator battery) incorporated into the measurement module.

Such a system can therefore be envisaged only for applications of limited duration and moreover has a relatively large overall size which constitutes an obstacle within the operating tubing. Furthermore, the wireless transmission system can be represented by a gigantic coaxial line. In such a coaxial line, the conductive core consists of the string of rods of the operating tubing, with its electrical properties, the internal insulator consists of the ground close to the well and the outer conductive casing consists of the ground situated at a greater distance from the well. It proves that the quality of transmission of the signal by such a wireless system is rather random, because it depends both on the type of structure of the operating tubing of the well and the resistivity of the geological formation to be traversed. The performance can thus vary considerably from one site to the next and within the same site, from one well to the next. Further, the choice of location of the sensor within the well is not very easy, since, in order for the emission of electromagnetic waves to be done in good conditions, the resistivity $\rho$ of the geological formation must be high enough in the vicinity of the well ($\rho>10\ \Omega\cdot m$ on average) and low at a certain point at the level of the sensor ($\rho<10\ \Omega\cdot m$ over several meters).

Finally, there must be mechanical contact at the level of the measurement module containing the sensor, between the operating tubing and the well structure (casing), to prevent the measurement module from being electrically insulated from the geological formation. Such a measurement module therefore risks not functioning correctly, particularly on wells in saline cavities having a suspended central tubing.

SUMMARY OF THE INVENTION

The present invention aims to remedy the drawbacks of the prior-art systems and to make it possible to take reliable measurements of physical parameters within operating wells over a long period at low cost.

DETAILED DESCRIPTION OF THE INVENTION

The invention further aims to facilitate the operations of positioning and depositing the most fragile parts of measuring devices, without it being necessary to carry out repair of the well structure.

These aims are achieved, according to the invention, owing to a device for the measurement of physical parameters in an operating well of a deposit or underground fluid storage reserve, which operating well includes an outer wall delimiting, with a central operating tubing of the well, an annular space in which is placed a protective sheath of an electrical link cable between a surface installation and elements arranged in the well, characterised in that it includes at least one compact, removable, sealed measuring subassembly arranged in a housing in communication with the interior of the central tubing and at least one compact, sealed connecting subassembly integral with the central tubing of the well and arranged at least partially in the annular space in the vicinity of said protective sheath in order to be connected to said electrical link cable and in that the sealed measuring subassembly and the sealed connecting subassembly have plane contact surfaces each associated with a half-transformer so as to form an inductive coupling between the measuring subassembly and the connecting subassembly.

The device according to the invention thus makes it possible to ensure in a damp environment a robust and reliable connection which is compact and enables the positioning and deposition of the measuring subassembly containing a sensor and the associated electronic circuits, by cable work within the operating tubing, from the surface, without requiring repair of the well structure.

The convenience of exchange of the removable measuring subassembly makes it possible to facilitate maintenance and to modify the configuration of the measuring subassembly according to requirements, which makes the system flexible and open-ended.

In the inductive coupling used within the framework of the device according to the invention, each half-transformer associated with a plane contact surface includes a magnetic circuit and a coil embedded in a solid material making it possible to withstand the forces of the pressure, such as a resin or a glass.

Advantageously, the half-transformers include thin welded non-magnetic metal sheets which constitute the plane contact surfaces and form part of sealed enclosures of the measuring and connecting subassemblies.

The measuring subassembly includes at least one sensor, an energy storage element and electronic circuits providing the interface between the half-transformer, the energy storage element and the sensor.

The electronic circuits include coding-decoding circuits and circuits for control of the power supply and for management of the information emitted by the sensor.

According to one particular embodiment, the measuring subassembly cooperates with positioning stops formed by the housing of the central tubing.

The measuring subassembly may include a profiled portion for positioning in the housing of the central tubing, while the connecting subassembly includes a profiled portion complementary to the profiled portion for positioning the measuring subassembly, to allow positioning of the connecting subassembly in the vicinity of the housing of the central tubing.

The connecting subassembly may traverse the wall of the housing of the central tubing in order to be situated partially in the annular space and partially in the housing in communication with the interior of the central tubing.

According to an advantageous embodiment, the electrical link cable cooperating with the connecting subassembly and the measuring subassembly forms a single-wire semi-duplex link for transmitting electrical signals alternately in descending fashion in the form of control signals and in ascending fashion in the form of data signals.

More particularly, the electrical link cable is adapted to transmit signals for electrical supply of the connecting subassembly and the measuring subassembly during the periods in which data signals are not transmitted.

The device according to the invention may include several measuring subassemblies associated with connecting subassemblies connected in parallel on the same electrical cable constituting a link in the form of a bus.

The invention also concerns a method for the measurement of physical parameters in an operating well of a deposit or underground fluid storage reserve, which operating well includes an outer wall delimiting, with a central operating tubing of the well, an annular space in which is placed a protective sheath of an electrical link cable between a surface installation and elements arranged in the well, characterised in that at least one sealed connecting subassembly arranged at least partially in said annular space and including a half-transformer is installed stationarily and integrally with the central operating tubing of the well, in the vicinity of the protective sheath and electrically connected to the electrical link cable, in that at least one compact, sealed measuring assembly provided with a half-transformer is introduced removably through the central tubing with the aid of a tool remotely controlled from the surface owing to a current-carrying cable and in that this measuring subassembly is positioned in a side pocket formed in the central tubing to which is fixed the connecting subassembly, in such a way that the measuring subassembly is coupled inductively to the connecting subassembly connected to the electrical link cable.

Advantageously, alternating low-frequency electrical signals for power supply of the measuring subassembly and data transmission and control signals are sent alternately an via the electrical link cable.

BRIEF DESCRIPTION OF THE DRAWINGS

Further characteristics and advantages of the invention will be apparent from the description below of particular embodiments given as examples, with reference to the attached drawings in which:

FIG. 1 is a schematic view in axial section of an operating well section in which is installed an example of a measuring device according to the invention, FIG. 2 is a view in axial section showing part of the well of FIG. 1 equipped with a measuring device according to the invention with a measuring subassembly and a connecting subassembly both equipped with an inductive coupling device, FIG. 5 is a block diagram showing an example of circuits incorporated into the device according to the invention, FIG. 6 is a timing diagram showing an example of signals exchanged between the measuring device according to the invention and a surface installation, and FIGS. 7 and 8 are views in axial section of two embodiments of inductive coupling devices applicable to the measuring device according to the invention.

DETAILED DESCRIPTION OF THE INVENTION

Figure 3:
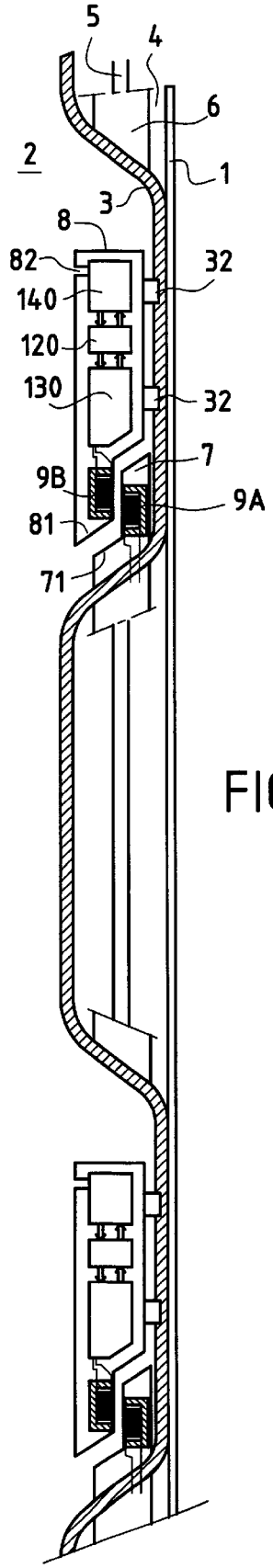
FIGS. 3 and 4 are schematic views in axial section showing variants of the measuring device according to the invention.

In FIG. 1 can be seen part of an operating well of a deposit or underground fluid storage reserve. The well includes an outer wall (casing) which delimits an annular space 4 with a central operating tubing 2 within which circulates the fluid extracted or injected in the underground storage.

The elements arranged in the annular space 4 are installed stationarily, and removal or exchange of them involves acting on the well structure itself. On the other hand, it is possible to have access to the elements arranged within the tubing 2 with the aid of remote-controlled tools connected by a current-carrying cable (logging cable) to the surface, so that removal or exchange of elements arranged within the tubing 2 can be effected at reasonable cost.

The central operating tubing 2 is equipped with lateral housings 3 in the form of pockets which are in communication with the interior of the tubing 2 and project into part of the annular space 4.

Compact, removable, sealed measuring subassemblies 8 are arranged in at least some of the lateral housings 3. Compact, sealed subassemblies 7 are arranged in the annular space 4 integrally with the lateral housings 3 containing the measuring subassemblies 8. The subassemblies 7 ensure connection to an electrical link cable 5 surrounded by a protective sheath 6. The electrical cable 5 and its protective sheath 6 are arranged stationarily in the annular space 4 of the well and are connected to a surface installation, traversing the well head 10.

The connecting subassemblies 7 connected to the electrical link cable 5 are arranged in the vicinity of the measuring subassemblies 8 and make it possible both to supply the latter with power and to transfer data or control signals between the surface installation and the measuring subassemblies.

The presence of measuring subassemblies 8 does not interfere with access in the central tubing 2 due to the compactness of these subassemblies 8 and their location in lateral housings 3. The central tubing 2 thus remains accessible at all points by traditional measuring tools, and its operation (injection or extraction) is not disturbed.

Structural examples of the connecting 7 and measuring subassemblies 8 will be described in more detail with reference to FIGS. 2 to 5 and 7, 8.

The measuring subassembly 8, which is placed removably in a lateral housing 3 of the central operating tubing 2, essentially comprises a sensor 140, which can be for example a temperature sensor, or a pressure sensor, but could also be a sensor of a physical quantity of another type varying relatively slowly (for example flow rate).

In the case of a pressure sensor, for example of the piezoelectric type, illustrated in the drawings, a metal pressure-measuring diaphragm 83 can be arranged in a pipe 82 passing through the sealed enclosure 80 of the module 8 with a system of seals and communicating with the interior of the central tubing 2 or, if occasion arises, with the annular space 4.

The measuring subassembly 8 further comprises an energy storage device 120. This energy storage device 120 may comprise a rechargeable battery or a capacitor.

In FIG. 5 can be seen an example of an energy storage device 120 comprising a diode rectifier bridge 121 associated with a capacitor 122 to supply the sensor 140 and electronic circuits 130 via lines 123.

The electronic circuits 130 of the measuring subassembly 8 provide the interface between the sensor 140, the energy storage device 120 and a half-transformer 9B designed to provide inductive coupling with the connecting subassembly 7.

As can be seen in FIG. 5, the electronic circuits 130 may essentially comprise coding-decoding circuits 131, 132 (transceiving circuits) and circuits 133 for control of the power supply and for management of the information emitted by the sensor 140 (meter interface with the sensor).

The invention makes it possible, if occasion arises, to modify, exchange or add to the electronic circuits 130, the sensor 140 and the energy storage device 120, by simple removal of the measuring subassembly 8 with the aid of a remote-controlled cable introduced into the interior of the central tubing 2, without in any way modifying the connecting subassembly 7 installed stationarily in the annular space 4. In this way, if elements of the measuring subassembly 8 have been damaged for example as a result of extreme temperatures, significant pressure or contact with an aggressive fluid, these elements can easily be replaced, so that the system can then continue to function with the connecting subassembly 7 still in place.

Referring again to FIG. 2, it can be seen that the sealed connecting subassembly 7 is arranged in the annular space 4 in the vicinity of the protective sheath 6 in order to be connected to the electrical link cable 5 and comprises a half-transformer 9A which cooperates with the half-transformer 9B of the measuring subassembly 8 to form an inductive coupling system 9.

More particularly, the half-transformer 9A of the connecting subassembly 7 is arranged behind a plane surface 95A forming part of the sealed enclosure of this subassembly, and the half-transformer 9B of the measuring subassembly 8 is arranged behind a plane surface 95B forming part of the sealed enclosure of this subassembly. The plane surfaces 95A, 95B are designed to cooperate with each other and ensure relative positioning of the two half-transformers 9A, 9B.

Each half-transformer 9A, 9B comprises a magnetic circuit 91A, 91B and a coil 92A, 92B embedded in a solid material 94A, 94B such as a resin or a glass, allowing pressure forces to be withstood.

The coil 92A of the half-transformer 9A is connected by connecting wires 93A to the cable 5 arranged in the annular space 4 and connected through a well head bushing 10 to a surface installation for power supply and processing of signals.

The coil 92B of the half-transformer 9B is connected by connecting wires 93B to the energy storage device 120, to the electronic circuits 130 and to the sensor 140.

Advantageously, the half-transformers 9A, 9B comprise thin welded non-magnetic metal sheets which form the plane contact surfaces 95A, 95B of low thickness and form part of the sealed enclosures of the connecting 7 and measuring subassemblies 8.

As shown in FIG. 2, each of the connecting 7 and measuring subassemblies 8 may cooperate with mechanical positioning stops 31 formed for example by machining in the housing 3 of the central tubing 2.

More particularly, a profiled portion 81 of the enclosure 80 of the measuring subassembly 8 ensures positioning of the measuring subassembly 8 in the housing 3. The enclosure of the connecting subassembly 7 has a profiled portion 71 complementary to the profiled positioning portion 81 of the measuring subassembly 8 in order to allow positioning of the connecting subassembly 7 integrally with the housing 3 of the central tubing 2.

The connecting subassembly 7, which is robust, is installed stationarily on the wall of the housing 3 in the annular space 4. The measuring subassembly 8, owing to its plane positioning surfaces, can be placed in a precise position in relation to the connecting subassembly 7, so that an optimum inductive coupling can be achieved.

The plane surfaces 95A, 95B with which are associated the coils 92A, 92B of the half-transformers 9A, 9B and which ensure signal transmission by inductive coupling can be oriented in different ways. These surfaces 95A, 95B can thus be horizontal (FIG. 7) or vertical (FIG. 8) or inclined.

In the last two configurations, the risks of debris being interposed between these surfaces 95A, 95B and impairing coupling are limited by increasing the distance between these surfaces. The plane surfaces 95A, 95B can be compact, with dimensions of less than about 40 mm.

The measuring system according to the invention, owing to its inductive coupling system between the connecting subassembly 7 and the measuring subassembly 8 and to the connecting subassembly 7 being produced in a compact, sealed form which allows communication only with the interior of the protective sheath 6 of the link cable 5, makes it possible to provide a robust, high-quality connection in a damp environment without the risk of deterioration in time. This connecting system is therefore well adapted to well-bottom sensors, although it can also be applied to sensors placed at the well head. Moreover, due to its being produced in the form of a compact, sealed module, the measuring subassembly 8 is capable of withstanding the severe environmental conditions present in the central operating tubing 2. At all events, the character of removability of the measuring subassembly 8 and its ease of exchange with the aid of a current-carrying cable facilitates maintenance of the system.

Various embodiments are possible. Thus, in FIG. 3 is shown an example of a measuring device according to the invention in which the connecting subassembly 7 passes through the wall of the housing 3 of the central tubing 2 to be situated partially in the annular space 4 and partially in the housing 3 which is in communication with the interior of the central tubing 2. In this case the lower profiled positioning portion 81 of the measuring subassembly 8 can cooperate directly with the complementary profiled portion 71 of the connecting subassembly 7. The measuring subassembly 8 may further cooperate with guide or fastening stops 32 formed on the wall of the housing 3. In the case of FIG. 3, an embodiment in which the housings 3 come to bear on the outer wall 1 has also been shown.

Figure 4:
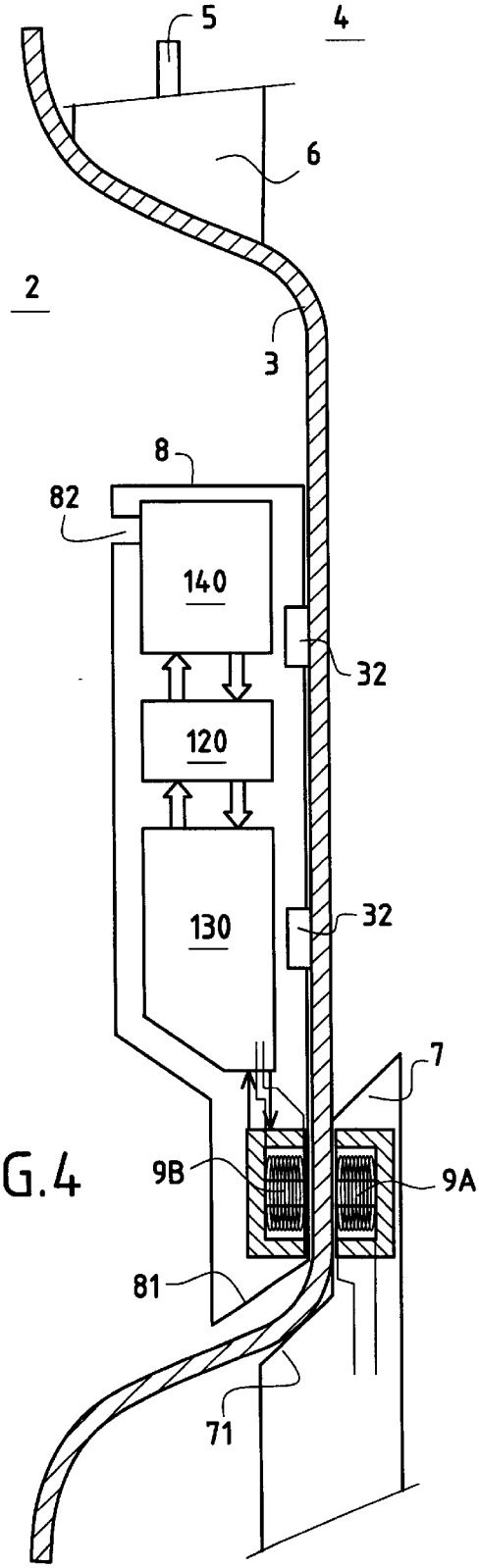

FIG. 4 shows an embodiment similar to that of FIG. 2, in which the connecting subassembly 7 is entirely situated in the annular space 4 and is fixed to the wall of the housing 3 without penetrating inside the latter. The embodiment of FIG. 4 shows a housing 3 having a simpler form than that of FIG. 2 in so far as the measuring module 8 cooperates with guide and fastening stops 32 formed on the side wall of the housing 3 of which the lower portion is thus easier to produce than in the case of FIG. 2 where the lower portion of the housing 3 defines a stop 31 in cradle form.

It will be noted that the whole measuring system according to the invention consumes little energy, which allows supply from the surface via the link cable 5 from an ordinary accumulator battery or a device of the solar panel type. Such a system can therefore be used in isolated places without causing significant extra cost and avoiding the use of a generating set requiring regular maintenance.

According to one particular characteristic of the invention, the electrical link cable 5 cooperating with the connecting subassembly 7 and the measuring subassembly 8 forms a single-wire semi-duplex link for transmitting electrical signals alternately in descending fashion in the form of control signals and in ascending fashion in the form of data signals.

More particularly, the electrical link cable 5 can be used so as to transmit power supply signals to the connecting subassembly 7 and the measuring subassembly 8 during the periods in which data signals are not transmitted.

Thus it is possible to send via the electrical link cable 5 alternately low-frequency alternating electrical signals which will be transmitted by inductive coupling to the measuring subassembly 8 and will serve to supply the energy storage device 120 with power, and data transmission and control signals applied to the electronic circuits 130 or emitted by the latter.

Thus, when the surface system wishes to obtain a series of measurements of a sensor, it sends via the cable 5 a control signal, with the aid of an alternating low-frequency signal which is transmitted inductively to the measuring subassembly 8 from the half-transformer 9A. In response the electronic circuits 130 associated with the sensor 140 send data signals originating from the sensor 140, by inductive coupling via the half-transformers 9A, 9B. Between two series of data signals, downward transmission serving to supply the reserve with power lasts long enough to recharge the energy storage device 120.

In FIG. 6 are shown by way of example timing diagrams of control and power supply signals 101 transmitted from the surface installation to the measuring device via the electrical link cable 5 and of data signals 102 transmitted from the measuring device to the surface installation via the electrical link cable 5. The descending signals 101 allowing the module 8 to be supplied have an amplitude $V_c$ and a duration $t_c$ greater than the amplitude $V_d$ and the duration $t_d$ of the energy-consuming data signals 102 originating from the module 8. Typical values of $t_c$ and $t_d$ are estimated by way of example as 20 and 2 seconds respectively. The duration $t_c$ must be long enough to supply the energy storage device 120 arranged in the removable module 8 and to allow the latter to emit an ascending data signal 102. The descending signal 101 serves simultaneously to supply the module 8 electrically and to send control signals. Transmission of the information, which requires little energy, can in fact be taken from the supply signal. As the complete cycle ($t_c$+$t_d$) lasts about 20 seconds, the device makes it possible to acquire data with a frequency of less than one minute, in the example considered above.

Supply of the electronic circuits 130 is permanently safeguarded by the energy storage device 120 comprising for example the capacitor 122.

The device according to the invention allows a variable measuring cycle monitored from the surface. It also allows connection (by inductive coupling) of several sensors to the same electrical cable 5. In this case several measuring subassemblies 8 associated with connecting subassemblies 7 connected in parallel on the same electrical cable 5 constituting a link in the form of a bus, are provided.

In this case, after reception of a control signal, all the sensors change to a high-impedance state. The sensor which is addressed sends a pattern containing the requested measurements. These signals pass through the two half-transformers 9A, 9B of the inductive coupling, then travel over the cable 5 to the surface. Transmission of the signals providing the power supply to the measuring subassemblies 8 is restored after reception of the ascending pattern of the last sensor interrogated.

In all cases, the inductive coupling protects the electronic circuits of the measuring subassemblies 8 against destructive excessive voltages of industrial or earth origin.

The connecting system according to the invention allows permanent functioning in a damp environment, for example for a well for working an underground natural gas reserve, at pressures and temperatures of up to 200 bars and 80° C. respectively or in a hydrocarbon production well at extreme pressure P and temperature T (for example P>1000 bars and T>175° C.). The connecting subassembly 7 has no moving parts. The measuring subassembly 8 can be connected and disconnected from the surface in relation to the connecting subassembly 7. In all cases, the electrical cable link 5 situated in the annular space 4 allows both bidirectional transmission of electrical signals and numerical data and supply of the measuring subassembly 8 with electricity.

What is claimed is:

1. Device for the measurement of physical parameters in an operating well of a deposit or underground fluid storage reserve, which operating well includes an outer wall delimiting, with a central operating tubing of the well, an annular space in which is placed a protective sheath of an electrical link cable between a surface installation and elements arranged in the well, characterised in that the device includes at least one compact, removable, sealed measuring subassembly arranged in a housing in communication with the interior of the central tubing and at least one compact, sealed connecting subassembly integral with the central tubing of the well and arranged at least partially in the annular space in the vicinity of said protective sheath in order to be connected to said electrical link cable and in that the sealed measuring subassembly and the sealed connecting subassembly have plane contact surfaces each associated with a half-transformer so as to form an inductive coupling between the measuring subassembly and the connecting subassembly.

2. Device according to claim 1, characterised in that each half-transformer associated with a plane contact surface includes a magnetic circuit and a coil embedded in a solid material making it possible to withstand pressure forces.

3. Device according to claim 2, characterised in that the solid material is a resin or a glass.

4. Device according to claim 1, characterised in that the half-transformers include thin welded non-magnetic metal sheets which constitute said plane contact surfaces and form part of sealed enclosures of said connecting and measuring subassemblies.

5. Device according to claim 1, characterised in that the measuring subassembly includes at least one sensor, an energy storage element and electronic circuits providing the interface between the half-transformer, the energy storage element and the sensor.

6. Device according to claim 5, characterised in that the electronic circuits include coding-decoding circuits and circuits for control of the power supply and management sensor of the information emitted by the sensor.

7. Device according to claim 5, characterised in that the energy storage element comprises a capacitor.

8. Device according to claim 5, characterised in that the energy storage element comprises a rechargeable battery.

9. Device according to claim 5, characterised in that the sensor comprises at least one sensor selected from among the following sensors: pressure sensor, temperature sensor, flow rate sensor.

10. Device according to claim 1, characterised in that the measuring subassembly cooperates with positioning stops formed by the housing of the central tubing.

11. Device according to claim 1, characterised in that the measuring subassembly includes a profiled portion for positioning in the housing of the central tubing.

12. Device according to claim 11, characterised in that the connecting subassembly includes a profiled portion complementary to the profiled portion for positioning the measuring subassembly to allow positioning of the connecting subassembly integrally with the housing of the central tubing.

13. Device according to claim 1, characterised in that the measuring subassembly is provided with means for being installed or removed through the interior of the central tubing with the aid of a tool remotely controlled by cable.

14. Device according to claim 1, characterised in that the connecting subassembly traverses the wall of the housing of the central tubing in order to be situated partially in said annular space and partially in the housing in communication with the interior of the central tubing.

15. Device according to claim 1, characterised in that the electrical link cable cooperating with the connecting subassembly and the measuring subassembly forms a single-wire semi-duplex link for transmitting electrical signals alternately in descending fashion in the form of control signals and in ascending fashion in the form of data signals.

16. Device according to claim 15, characterised in that the electrical link cable is adapted to transmit signals for electrical supply of the connecting subassembly and the measuring subassembly during the periods in which data signals are not transmitted.

17. Device according to claim 1, characterised in that the connecting subassembly and the protective sheath define a sealed enclosure.

18. Device according to claim 1, characterised in that it the device comprises several measuring subassemblies associated with the connecting subassemblies connected in parallel on the same electrical cable constituting a link in the form of a bus.

19. Device according to claim 1, characterised in that it the device is applied to an operating well of an underground natural gas reserve.

20. Method for the measurement of physical parameters in an operating well of a deposit or underground fluid storage reserve, which operating well includes an outer wall delimiting, with a central operating tubing of the well, an annular space in which is placed a protective sheath of an electrical link cable between a surface installation and elements arranged in the well, characterised in that at least one sealed connecting subassembly arranged at least partially in said annular space and including a half-transformer is installed stationarily and integrally with the central operating tubing of the well, in the vicinity of the protective sheath and electrically connected to the electrical link cable, in that at least one compact, sealed measuring assembly provided with a half-transformer is introduced removably through the central tubing with the aid of a tool remotely controlled from the surface owing to a current-carrying cable and in that this measuring subassembly is positioned in a side pocket formed in the central tubing to which is fixed the connecting subassembly, in such a way that the measuring subassembly is coupled inductively to the connecting subassembly connected to the electrical link cable.

21. Method according to claim 20, characterised in that alternating low-frequency electrical signals for power supply of the measuring subassembly and data transmission and control signals are sent alternately via the electrical link cable.

* * * * *